US006651454B1

(12) United States Patent
Spiegel

(10) Patent No.: US 6,651,454 B1
(45) Date of Patent: Nov. 25, 2003

(54) FLEX PORT BASE FOR SWIMMING POOL AND SPA HEAT PUMPS

(76) Inventor: Bill Spiegel, 203 S. Manatee, Arcadia, FL (US) 34266

( * ) Notice: Subject to any disclaimer, the term of this patent is extended or adjusted under 35 U.S.C. 154(b) by 0 days.

(21) Appl. No.: 10/165,351

(22) Filed: Sep. 30, 2002

(51) Int. Cl.[7] ..... F25D 19/00; F25D 23/12

(52) U.S. Cl. ..... 62/259.1; 62/297

(58) Field of Search ..... 62/259.1, 297, 62/298, 288; 248/678

(56) References Cited

U.S. PATENT DOCUMENTS 2,935,366 A * 5/1960 Cahn ..... 312/213
4,916,918 A * 4/1990 Marelli ..... 62/259.1

* cited by examiner

*Primary Examiner*—Chen Wen Jiang
(74) *Attorney, Agent, or Firm*—Frank A. Lukasik

(57) ABSTRACT

An elevating system for a heat pump through which plumbing may be installed to permit multiple configurations of the plumbing the system consisting of a base having a floor and four sides, the floor having two holes to accommodate the inlet and outlet pipes of the heat pump and a selection of two or four holes in the sides forming an empty space beneath the floor.

3 Claims, 5 Drawing Sheets

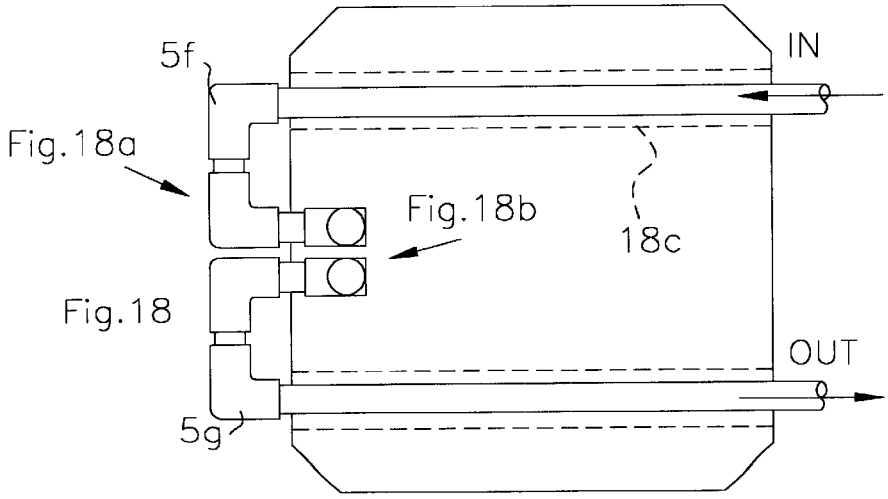
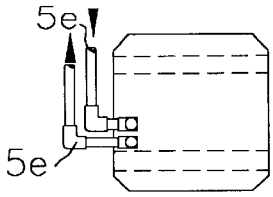
Fig.19
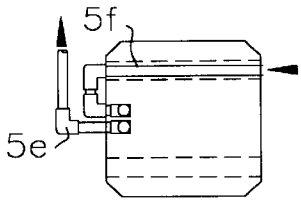
Fig.20
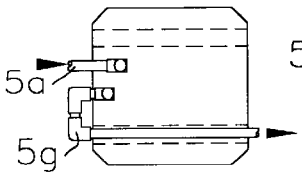
Fig.21
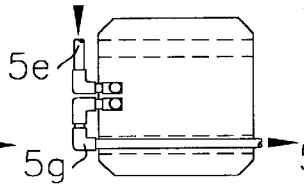
Fig.22
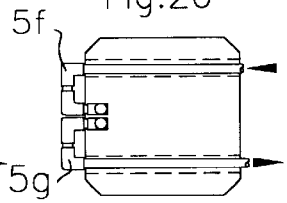
Fig.23
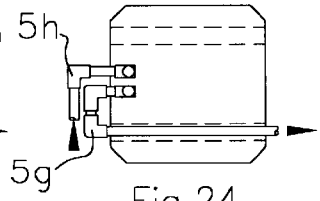
Fig.24
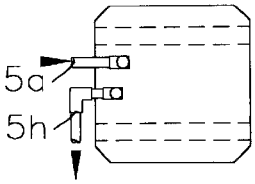
Fig.25
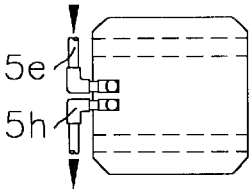
Fig.26
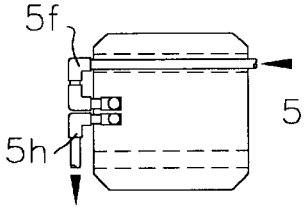
Fig.27
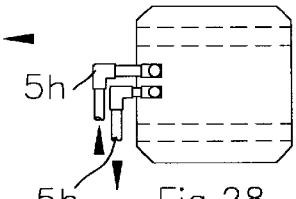
Fig.28
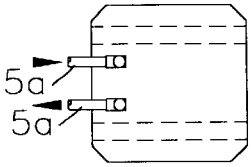
Fig.29
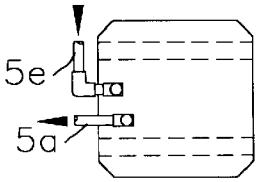
Fig.30
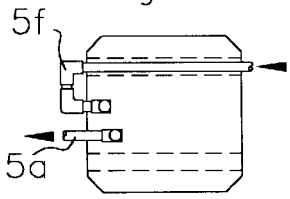
Fig.31

FLEX PORT BASE FOR SWIMMING POOL AND SPA HEAT PUMPS

BACKGROUND OF THE INVENTION

The present invention relates to methods for plumbing heat pumps used in swimming pools and spas, and more specifically, to an elevating base through which plumbing can be installed to permit multiple configurations of the plumbing.

Prior art swimming and spa heat pumps have historically, only two plumbing ports. One port allows water to flow from the pump and filter into the heat pump and the second pump allows water to come back out of the heat pump and into the pool or spa. These ports usually are located on the front or side of the unit for easy access. This configuration however, limits the number of plumbing options and front installation in particular, interferes with access to the unit for repairs and adjustment. It also makes it difficult for the user to access the controls.

By enabling the use of multiple plumbing ports, the present invention allows for greater flexibility during installation and provides a neater, more accessible installation.

Heat pumps require large evaporator surfaces to collect heat from the ambient air. For maximum efficiency, the evaporator wraps around the outside of the unit and cannot be penetrated by plumbing ports. Heat pump manufacturers leave an opening to allow for plumbing ports.

The present invention "flex" port base adapts to existing heat pumps and creates an elevated base through which multiple plumbing configurations are effected.

SUMMARY OF THE INVENTION

The primary purpose of the invention is to provide a base which elevates the existing or prior art heat pump sufficiently to permit the installation of various plumbing configurations which connect to the existing plumbing ports of the heat pump.

It is a further purpose of the invention to adapt to existing heat pumps however their plumbing is configured.

It is a further purpose of the invention to permit plumbing port installations on any side of the heat pump so that plumbing will not interfere with the user's access to the controls.

It is a further purpose of the invention to provide chases beneath the base by which piping can be run under the heat pump. (Chase: def 2. a groove, furrow, or channel, as one made in a wall for pipes or ducts. Webster's College Dict.)

DETAILED DESCRIPTION OF A PREFERRED EMBODIMENT.

The invention is comprised of a base formed from durable material substantial enough to form a support base for a heat pump. The base is formed with four vertical sides, a top face and a bottom lip edge. The top face has openings to admit extensions from the existing heat pump plumbing into the open space within the four sides of the base. Each of the base sides has holes through which further plumbing can be installed allowing an optimum configuration and full access to the heat pump controls. In a further embodiment, the base is fitted with chases which allow pipes to be run beneath the base by an installer. In this embodiment, as in the first embodiment, the internal plumbing of the heat pump is brought down through the base instead of the conventional method of out the side.

BRIEF DESCRIPTION OF THE DRAWINGS

A prior art illustration of a typical heat pump.

FIGS. 17–31 are diagrammatic representations of various plumbing options made available by the addition of chases in a further embodiment of the present invention.

DETAILED DESCRIPTION OF THE PREFERRED EMBODIMENT

Figure 1:
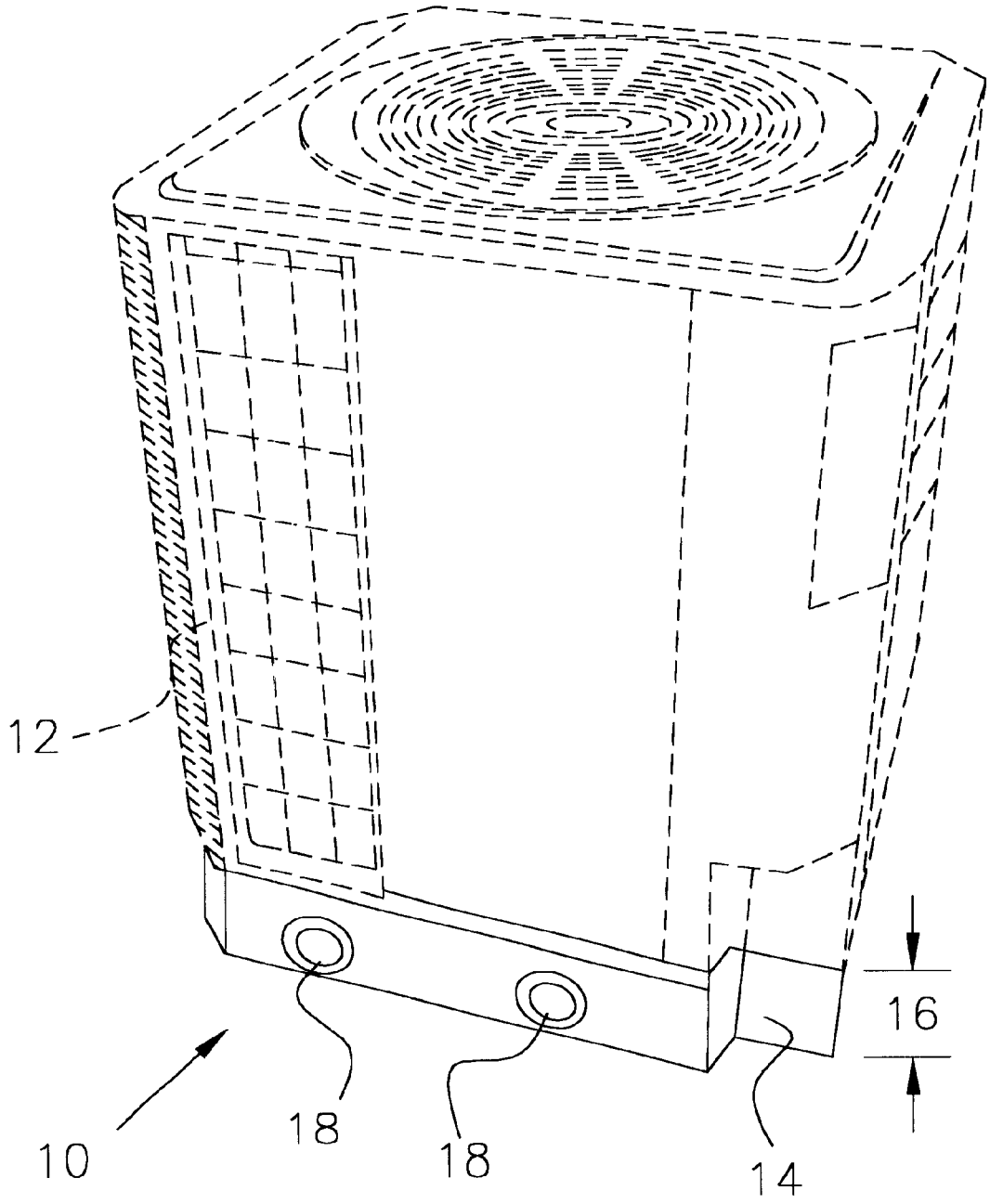
FIG. 1 is an isometric view partially in section of the invention attached to the base of a typical heat pump.
Figure 2:
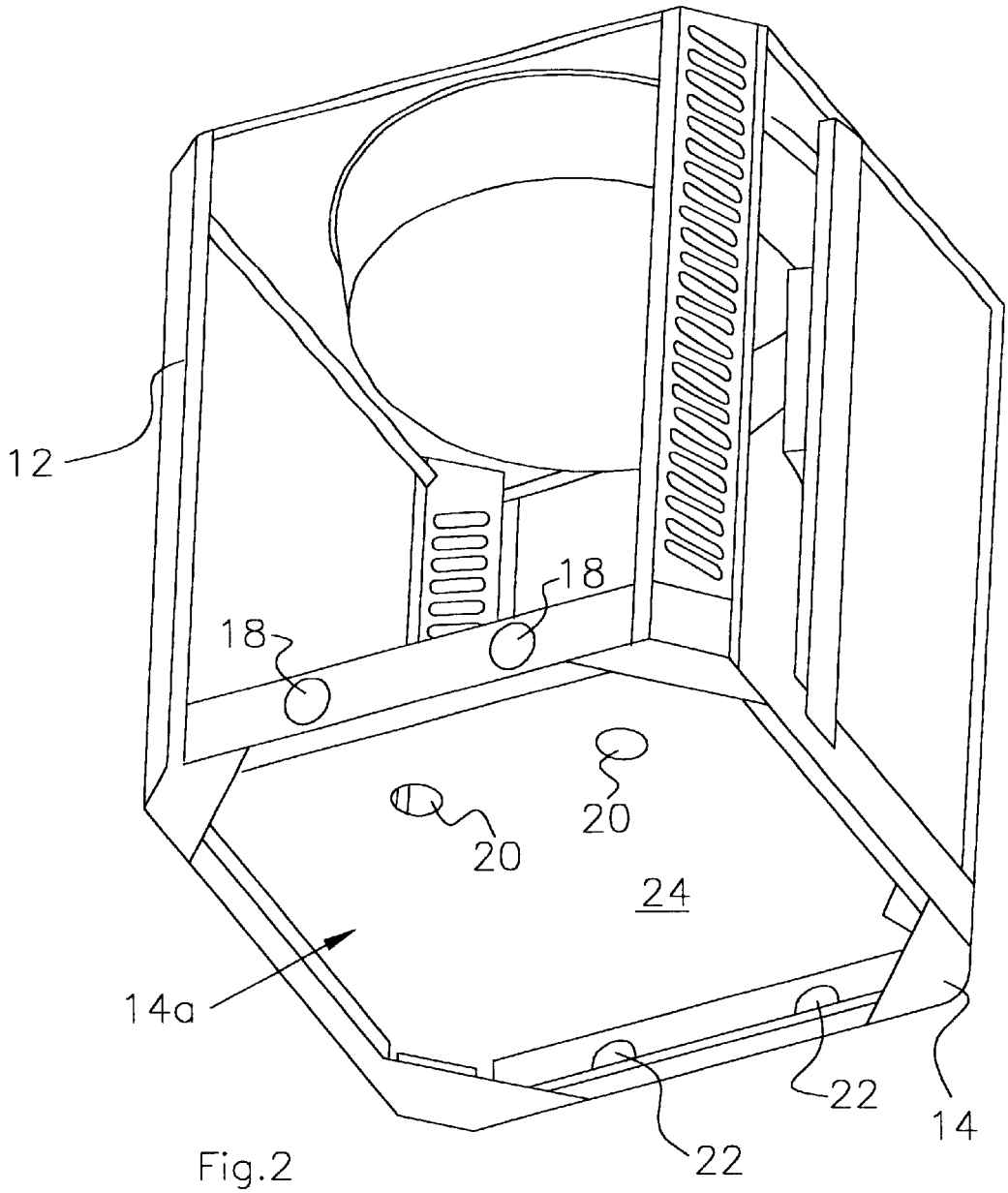
FIG. 2 is a bottom isometric view of a heat pump chassis showing the invention as described.

Referring now to the drawings wherein like numerals designate like and corresponding parts throughout the several views, in FIGS. 1 and 2, a prior art unit 12 sits atop base 14, which has access holes 18 in its front panel. Height 16 illustrates the elevation provided by base 14. FIG. 2 is a bottom view showing the openings 18 on two opposite sides of base 14 which could be formed on all four sides, allowing for plumbing connections on all four faces of the base 14. Front panel height 16 illustrates the elevation provided by base 14.

Holes 22 provide rear access while holes 20 in floor 24 allow the original heat pump plumbing to be re-routed into space 14*a*.

Figure 3:
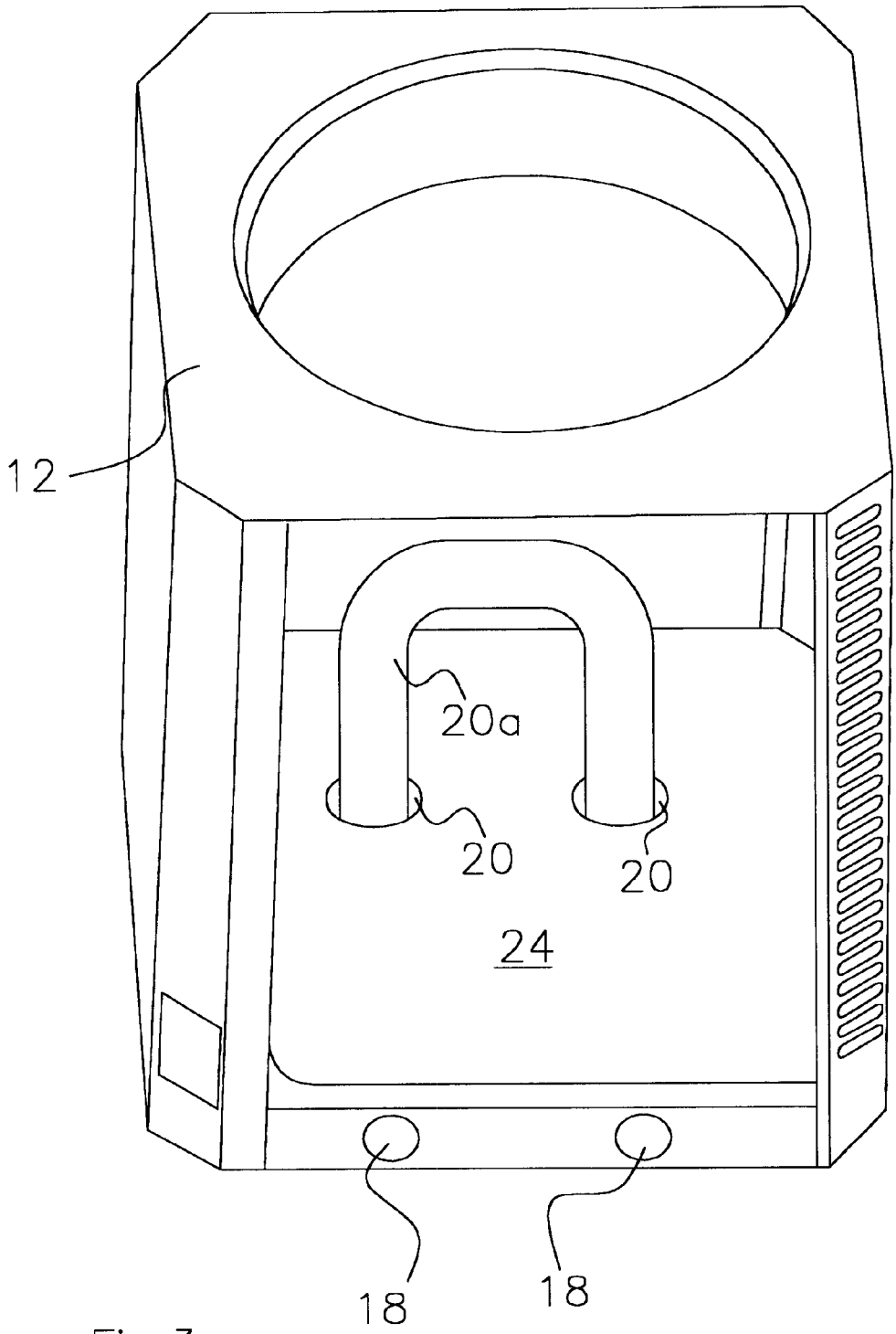
FIG. 3 is a top isometric view of a heat pump chassis showing the invention as described.

FIG. 3 shows the internal plumbing assembly 20*a* being routed through holes 20 in floor 24.

Figure 4:
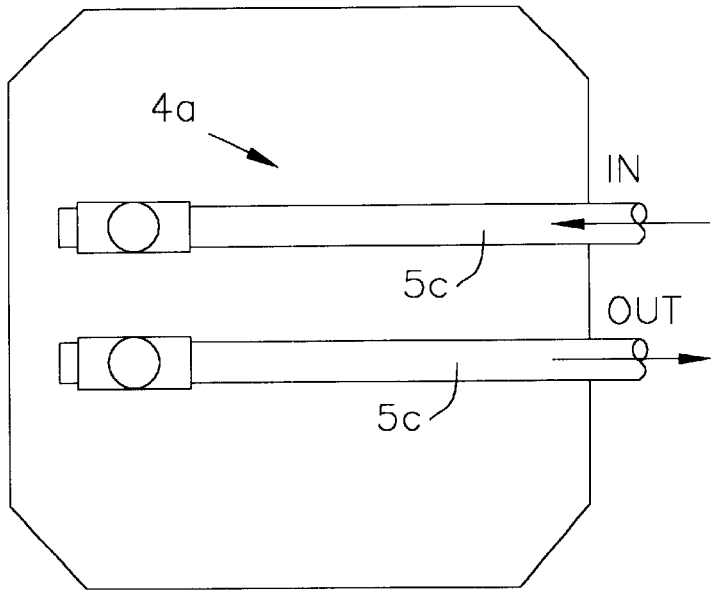
FIG. 4 is a diagrammatic representation of the lower plumbing configuration of a heat pump.

FIG. 4 illustrates a first plumbing configuration that can be accomplished with the instant invention. FIG. 4, shows the normal layout of heat pump plumbing 4*a* as provided by a manufacturer. Pipes 5*c* provide the normal in/out coolant flow. With the location of holes in the prior art, the internal plumbing of the heat pump is brought out of one side only.

FIGS. 5–17 illustrate the variations of plumbing configuration available once base 14 (FIGS. 1–3) is installed. for purposes of illustration the base is described as having left side one, top side two, right side three, and bottom side four.

Figure 5:
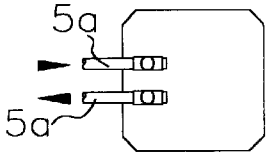
FIGS. 5–17 are diagrammatic representations of various plumbing options made available by the present invention.

FIG. 5 shows inlet and outlet pipes 5*a* mounted through two holes 18 in side one of the base 14.

Figure 6:
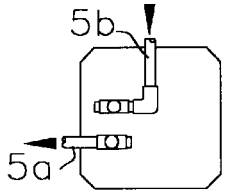

FIG. 6 shows inlet pipe 5*b* coming in from side two and outlet pipe 5*a* going out through side one.

Figure 7:
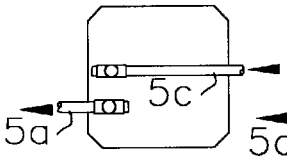

FIG. 7 shows inlet pipe 5*c* coming in side one and exiting through side three.

Figure 8:
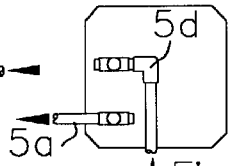

FIG. 8 shows inlet pipe 5*d* coming in on side four and outlet pipe 5*a* exiting through side one.

Figure 9:
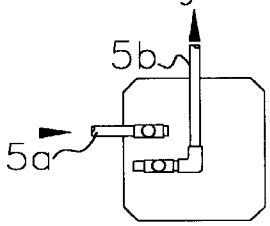

FIG. 9 shows inlet pipe 5*a* coming in side one and exiting through side two.

Figure 10:
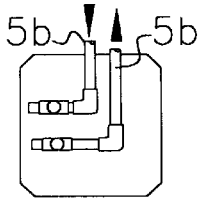

FIG. 10 shows inlet pipe and outlet pipe 5*b* installed through side two.

Figure 11:
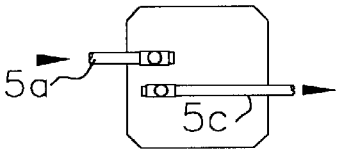

FIG. 11 shows inlet pipe 5*a* coming in on side one and outlet pipe 5*c* exiting through side three.

Figure 12:
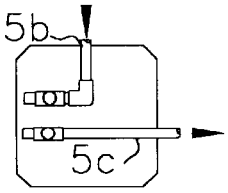

FIG. 12 shows inlet pipe 5*b* coming in on side two and exiting through side three.

Figure 13:
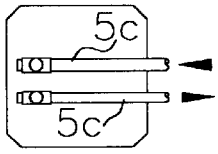

FIG. 13 shows inlet and outlet pipes 5*c* mounted through holes 18 in side three.

Figure 14:
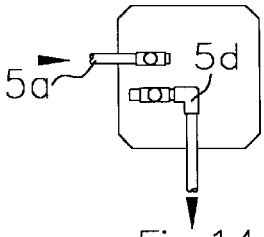

FIG. 14 shows inlet pipe 5*a* coming in on side one and outlet pipe exiting through side three.

Figure 15:
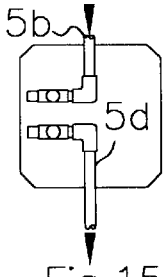

FIG. 15 shows inlet pipe 5*b* coming in on side two and outlet pipe 5*d* exiting through side three.

Figure 16:
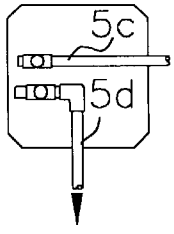

FIG. 16 shows inlet pipe 5*c* coming in on side three and exiting through side three.

Figure 17:
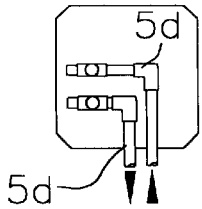

FIG. 17 shows inlet pipe and outlet pipe 5*d* mounted through holes 18 in side four.

FIG. 18 shows the same concept described above utilizing only elbows and pipe chases 18*c* to accomplish much the same flexibility. Chases 18*c* are provided under the base 14 which allow pipes to be run by the installer. The piping options shown in FIGS. 18–31 are still created by bringing the internal plumbing 20*a* of the heat pump down through the bottom of the base 14 instead of the conventional method of out one side.

The above description illustrates the number of different plumbing configurations that can be accomplished using the base 14 of the invention. The configurations are accomplished by utilizing plumbing tees and elbows and plugs or caps.

What is claimed is:

1. An elevating system for a heat pump through which plumbing may be installed to permit multiple configurations of the plumbing, said system consisting of:

a base having a floor, a pair of side panels spaced horizontally from each other and a front panel and a rear panel, each of said panels assembled together and to said floor to form an empty space, and a pair of holes formed in said floor and a pair of holes formed in said front panel and said rear panel, said pairs of holes formed in said floor being aligned with a center line drawn across said empty space between said pair of holes in said front panel and said rear panel, said base having a plurality of pipes, said pipes being connected to inlet and outlet pipes of the heat pump, said pipes being configured to pass through said holes formed in said floor and selected holes in said panels.

2. An elevating system as claimed in claim 1 wherein a pair of chases are formed in said floor of said base, said chases formed across said empty space, each chase forming a connection between said holes formed in said front and rear panels.

3. An elevating system of claim 1 wherein a pair of holes are formed in each of said side panels.

* * * * *